US012516511B2

(12) United States Patent
Li

(10) Patent No.: US 12,516,511 B2
(45) Date of Patent: Jan. 6, 2026

(54) MULTIFUNCTIONAL SHOWER DEVICE

(71) Applicant: Jian Li, Guangdong (CN)

(72) Inventor: Jian Li, Guangdong (CN)

( * ) Notice: Subject to any disclaimer, the term of this patent is extended or adjusted under 35 U.S.C. 154(b) by 134 days.

(21) Appl. No.: 18/597,035

(22) Filed: Mar. 6, 2024

(65) Prior Publication Data

US 2025/0283310 A1 Sep. 11, 2025

(51) Int. Cl.
*E03C 1/02* (2006.01)
*E03C 1/04* (2006.01)
*E03C 1/06* (2006.01)

(52) U.S. Cl.
CPC ..... *E03C 1/025* (2013.01); *E03C 1/0408* (2013.01); *E03C 1/06* (2013.01)

(58) Field of Classification Search
CPC ..... E03C 1/025; E03C 1/0408; E03C 1/06
See application file for complete search history.

(56) References Cited

U.S. PATENT DOCUMENTS

2020/0181894 A1* 6/2020 Chung ..... A47K 3/281
2023/0399829 A1* 12/2023 Qian ..... F16K 27/003
2024/0018758 A1* 1/2024 Ladrón Jiménez ... E03C 1/0408

FOREIGN PATENT DOCUMENTS

CN 217951317 U * 12/2022

* cited by examiner

*Primary Examiner* — Christine J Skubinna

(57) ABSTRACT

A multifunctional shower device, comprising shower body and concealed body, wherein the rear end of shower body is connected to concealed body; top end of said concealed body is connected to a plurality of water outlet devices, and bottom end thereof is connected to cold water inlet pipe and hot water inlet pipe, and water flow in the cold water inlet pipe and hot water inlet pipe flows into shower body for temperature regulation; the temperature-regulated water flow controlled by shower body is flowed out from one or more outlet devices; said water outlet devices are one or more combinations of overhead shower, handheld shower, faucet, dual-function overhead spray member, and side spray shower. The invention can increase number of movable blocks according to people's demand for using water outlet device, so as to obtain a concealed body structure meeting people's demand.

8 Claims, 9 Drawing Sheets

MULTIFUNCTIONAL SHOWER DEVICE

1. TECHNICAL FIELD

The invention relates to the technical field of shower device, in particular to a multifunctional shower device.

2. BACKGROUND ART

Concealed shower faucet is a kind of pre-buried faucet to make the bathroom more beautiful. When walls are built, the concealed shower faucet is set inside the cement wall, and the control switch is set on the outside of the cement wall, which improves the aesthetic effect and saves the internal space in the bathroom at the same time, using effect of which is desirable; the patent number CN202220716236.5 discloses a concealed shower valve, however, the concealed body in the concealed shower faucet is an integrated structure, the number of water outlets are fixed and cannot be adjusted according to people's use, with low applicability; therefore, it is necessary to improve it.

3. SUMMARY OF THE INVENTION

Aimed at above mentioned problem, the invention provides a multifunctional shower device characterized in simple structure and convenient to use.

In order to achieve said purpose, the technical scheme provided by the invention is as follows:

a multifunctional shower device, comprising a shower body and a concealed body, wherein the rear end of the shower body is connected to the concealed body; the top end of said concealed body is connected to a plurality of water outlet devices, and the bottom end thereof is connected to the cold water inlet pipe and hot water inlet pipe, and water flow in the cold water inlet pipe and hot water inlet pipe flows into the shower body for temperature regulation; the temperature-regulated water flow controlled by the shower body is flowed out from one or more outlet devices; said water outlet devices are one or more combinations of overhead shower, handheld shower, faucet, dual-function overhead spray member, and side spray shower.

Furthermore, the rear end of said shower body is sequentially provided with a cold water inlet, a plurality of functional water outlets and a hot water inlet, a switch cavity is provided on one side of the front end of the shower body and a switch component is mounted in the switch cavity; a plurality of control cavities are provided at the front end of the shower body, a plurality of control cavities are set according to a plurality of corresponding functional water outlets and control components are mounted in the control cavities; in the shower body is provided with an upper cavity and a lower cavity from the top to the bottom; the upper cavity, lower cavity, switch cavity and a plurality of control cavities are all relatively independent; in the upper cavity is provided with the first separator plate and the upper cavity is divided into the first connecting cavity and a plurality of second connecting cavities via the first separator plate; the switch cavity is connected to a plurality of control cavities through the first connecting cavity, a plurality of second connecting cavities are set according to a plurality of corresponding control cavities and the control cavities are connected to the corresponding functional water outlets through the second connecting cavities; in the lower cavity is provided with the second separator plate and the lower cavity is divided into relatively independent cold water cavity and hot water cavity via the second separator plate wherein the cold water cavity is connected to the cold water inlet and switch cavity respectively, and the hot water cavity is connected to the hot water inlet and switch cavity respectively.

Furthermore, in said concealed body is sequentially provided with a cold water inlet channel, a plurality of water outlet channels, and a hot water inlet channel wherein the bottom end of cold water inlet channel is connected with the cold water inlet pipe and the top end of cold water inlet channel is connected with the cold water inlet at the rear end of the shower body; the bottom end of hot water inlet channel is connected with the hot water inlet pipe and the top end of hot water inlet channel is connected with the hot water inlet at the rear end of the shower body; a plurality of water outlet channels are provided in correspondence with a plurality of functional water outlets at the rear end of the shower body, the bottom end of the water outlet channels are connected to the corresponding functional water outlets, and the top end of the water outlet channels are connected to the water outlet device.

Furthermore, said concealed body includes a fixed block and a plurality of movable blocks, a plurality of movable blocks are set side by side on one side or both sides of the fixed block, and the fixed block and movable blocks or adjacent movable blocks are detachably connected with each other via mortise and tenon joint or buckle structure; said fixed block is equipped with a cold water inlet channel, a plurality of first water outlet channels, and a hot water inlet channel; one end of the cold water inlet channel is connected with the cold water inlet pipe, one end of the hot water inlet channel is connected to the hot water inlet pipe, and the other end of the cold water inlet channel and hot water inlet channel are both connected to the shower body set in the front end of concealed body; each movable block is provided with a second water outlet channel; one end of the first outlet channels and the second water outlet channel are both connected to the shower body, while the other end of the first water outlet channel and second water outlet channel are both connected to the water outlet devices.

Furthermore, said cold water inlet channel, a plurality of water outlet channels, and hot water inlet channel are provided with mounting connectors at one end connected to the shower body and are connected to the cold water inlet, a plurality of functional water outlets, and the hot water inlet at the rear end of the shower body via the mounting connectors, and two ends of the mounting connector are in threaded connection with the concealed body and the shower body, respectively; sealing washers are provided between the mounting connector and the shower body, and between the mounting connector and the concealed body; the sealing washer is socketed on the outside of both ends of the mounting connector.

Furthermore, said switch component includes a switch valve core, the first gland, and a switch handle wherein the switch valve core is embedded in the switch cavity, the first gland is connected to the inside wall of the switch cavity; the control terminal at one end of the switch valve core is connected to the switch handle after penetrating through the center hole of the first gland.

Furthermore, said control component comprises a control valve core, the second gland, and a control knob wherein the control valve core is embedded in the control cavity, the second gland is connected to the inside wall of the control cavity, and the control terminal at one end of the control valve core is connected to the control knob after penetrating through the center hole of the second gland.

Furthermore, said dual-function overhead spray member includes a top shell, which is a hollow shell structure, top spray holes are provided at the bottom front end of the top shell, a waterfall outlet shell is provided at the back end of the top shell, a waterfall outlet is provided at the bottom end of the waterfall outlet shell and the waterfall outlet extends from the bottom back end of the top shell; the back end of the top shell is provided with the first water flow connector to be connected to the inside of the top shell and the second water flow connector to be connected to the inside of the waterfall outlet shell; the first water flow connector and the second water flow connector are connected to the pipes of two water outlet channels respectively.

Furthermore, said side spray shower includes a mounting pipe, which is longitudinally arranged, and the bottom end of the mounting pipe is connected to the water outlet channel; a plurality of mounting interfaces are set at equal spacing on the side wall of the mounting pipe along the lengthwise direction of the mounting pipe and are connected to the shower head through the mounting interfaces.

Furthermore, said concealed body, cold water inlet pipe, hot water inlet pipe, and connecting pipes of each water outlet device are pre-buried in the building wall.

Compared with the prior art, the invention has following advantages and positive effects:

The invention adopts the design of setting the upper cavity and lower cavity from top to bottom in the shower body, so that when in use, it enables the lower cavity, divided into cold water cavity and hot water cavity, supplies water for the switch cavity; the switch component in the switch cavity regulates the temperature of the incoming water flow, then the water flow enters into the control cavity through the first connecting cavity, and then the water flow state is controlled through the control component, after which the water flows out through the corresponding second connecting cavities and the corresponding functional water outlets, finally realizing water discharge of different water outlet devices; its structure is simple and convenient for operation, enhancing the using effect of shower device;

Through utilizing that the fixed block and movable blocks can be detachably connected to form the design of concealed body, in the use of the invention, the cold water inlet pipe and hot water inlet pipe can be respectively connected to the cold water inlet channel and the hot water inlet channel on the fixed block, and then the first water outlet channel on the fixed block and the second water outlet channel on the movable block can be connected to the water outlet device; the number of movable blocks can be increased to meet people's use demand for the water outlet device so as to obtain a concealed body structure that meets people's demand; its assembly operation is convenient and quick, which reduces the production cost of the shower device and further improves the using effect of the shower device;

On the other hand, when installing the invention, the concealed body and all kinds of pipes are pre-buried in the wall, and only the shower body is exposed outside the wall, which not only facilitates the operation and control of the shower equipment but also facilitates the disassembling and maintenance of the shower device in future. At the same time, it avoids the exposure of various pipes in the bathroom, effectively improving the aesthetic effect in the bathroom, thus improving the use effects of the invention.

4. BRIEF DESCRIPTION OF ACCOMPANY DRAWINGS

In order to illustrate the preferred embodiment of the invention or the technical scheme more clearly, the technical scheme of the preferred embodiment or the figures required by the prior art is further described briefly. Obviously, only partial embodiments of the invention are shown and the actual structure is not limited thereto. It is to be understood by those skilled in the art that other drawings can be obtained based on the drawings of the invention with non-creative labor.

5. SPECIFIC EMBODIMENT OF THE INVENTION

Figure 1:
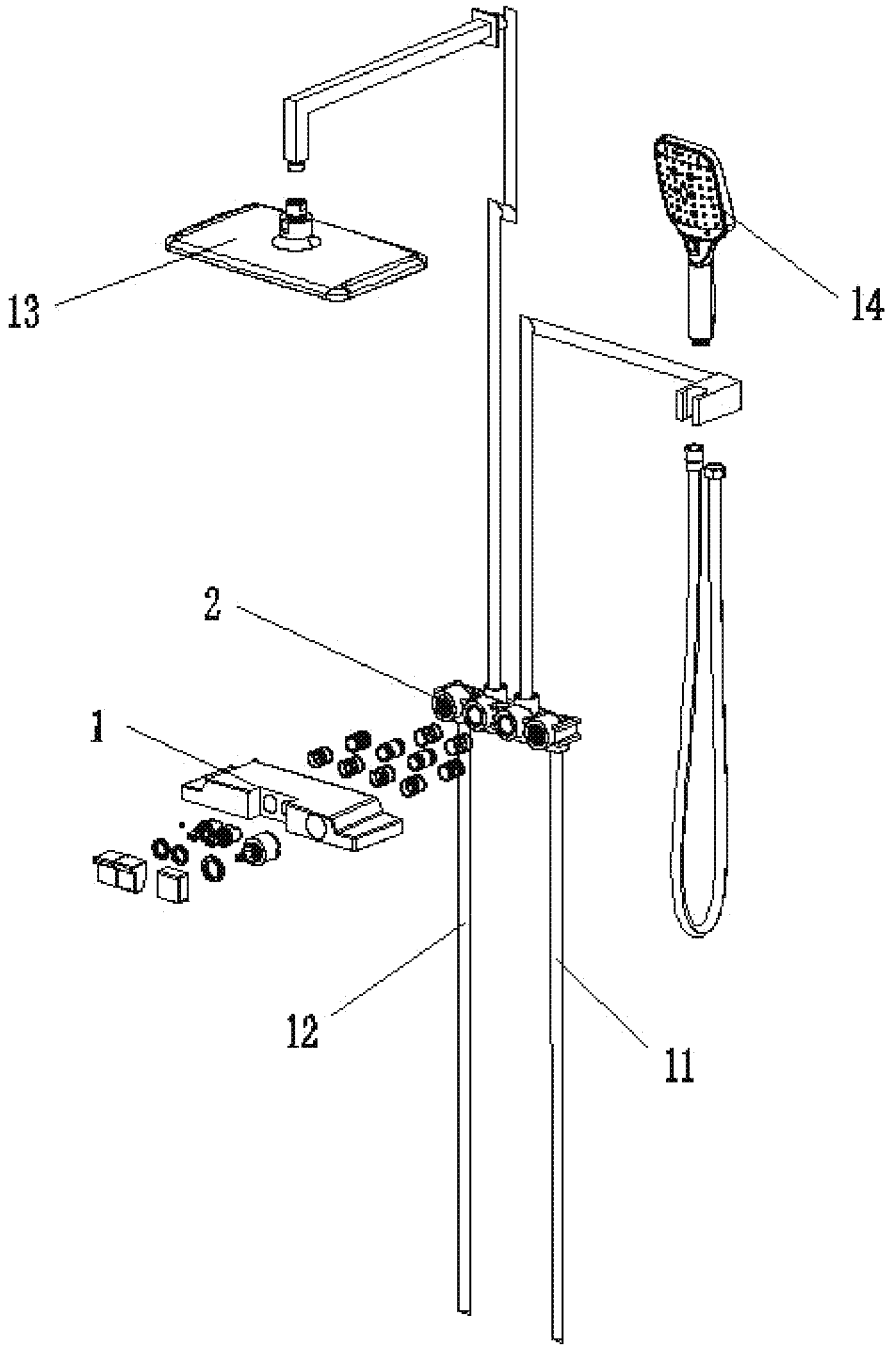
FIG. 1 is the structural diagram of embodiment 1.
Figure 2:
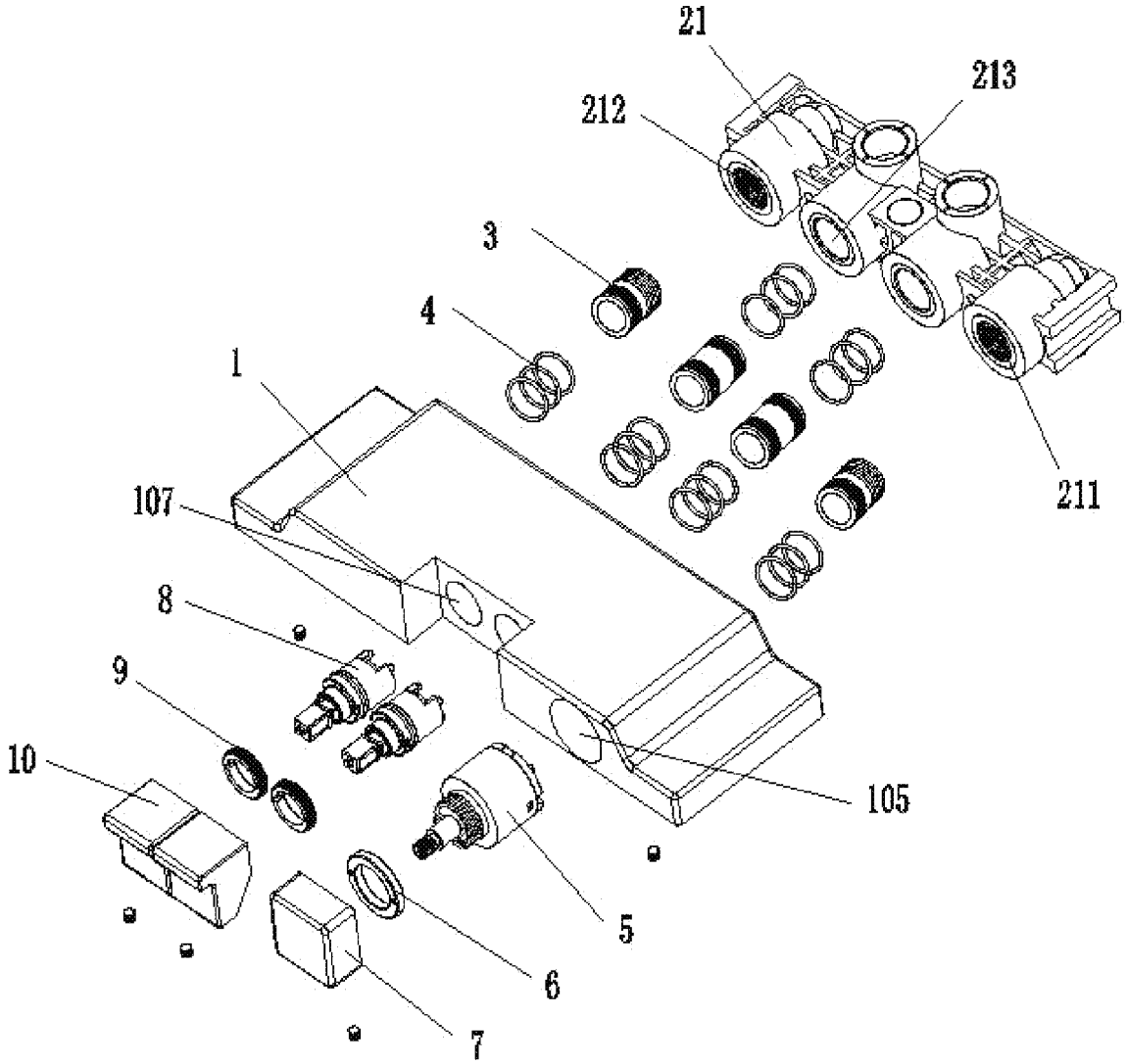
FIG. 2 is the assembly structure diagram of the shower body and concealed body of embodiment 1.
Figure 3:
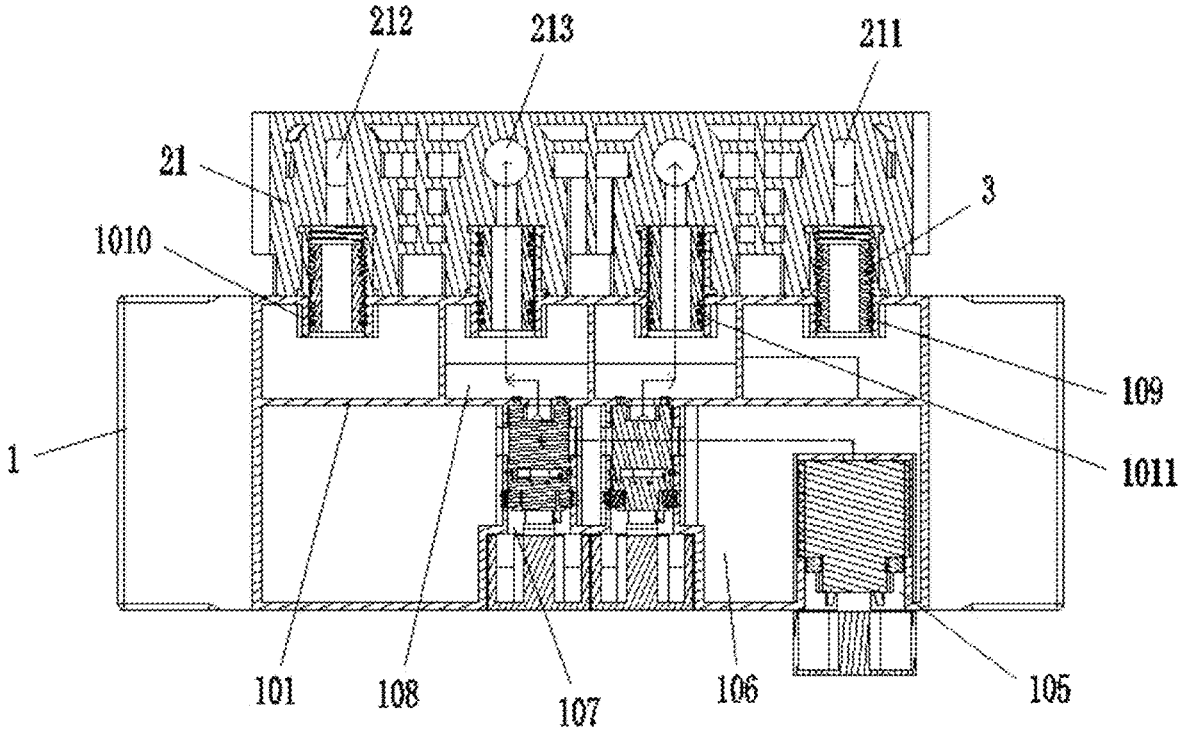
FIG. 3 is the sectional diagram of the upper structure of the shower body in embodiment 1.
Figure 4:
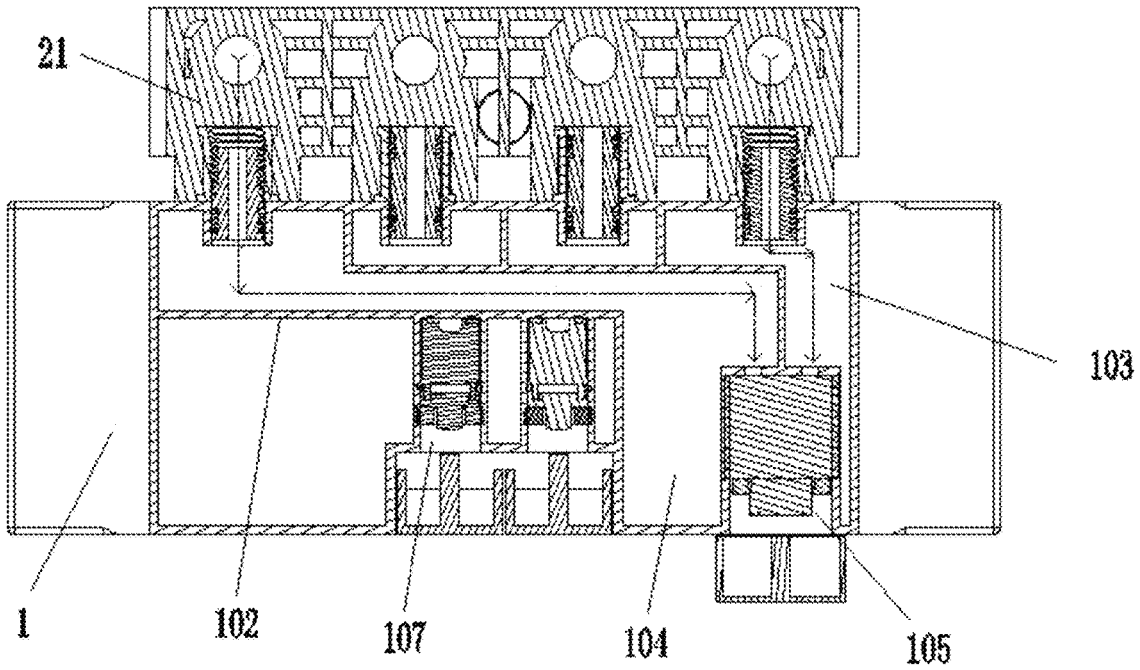
FIG. 4 is the sectional diagram of the lower structure of the shower body in embodiment 1.
Figure 5:
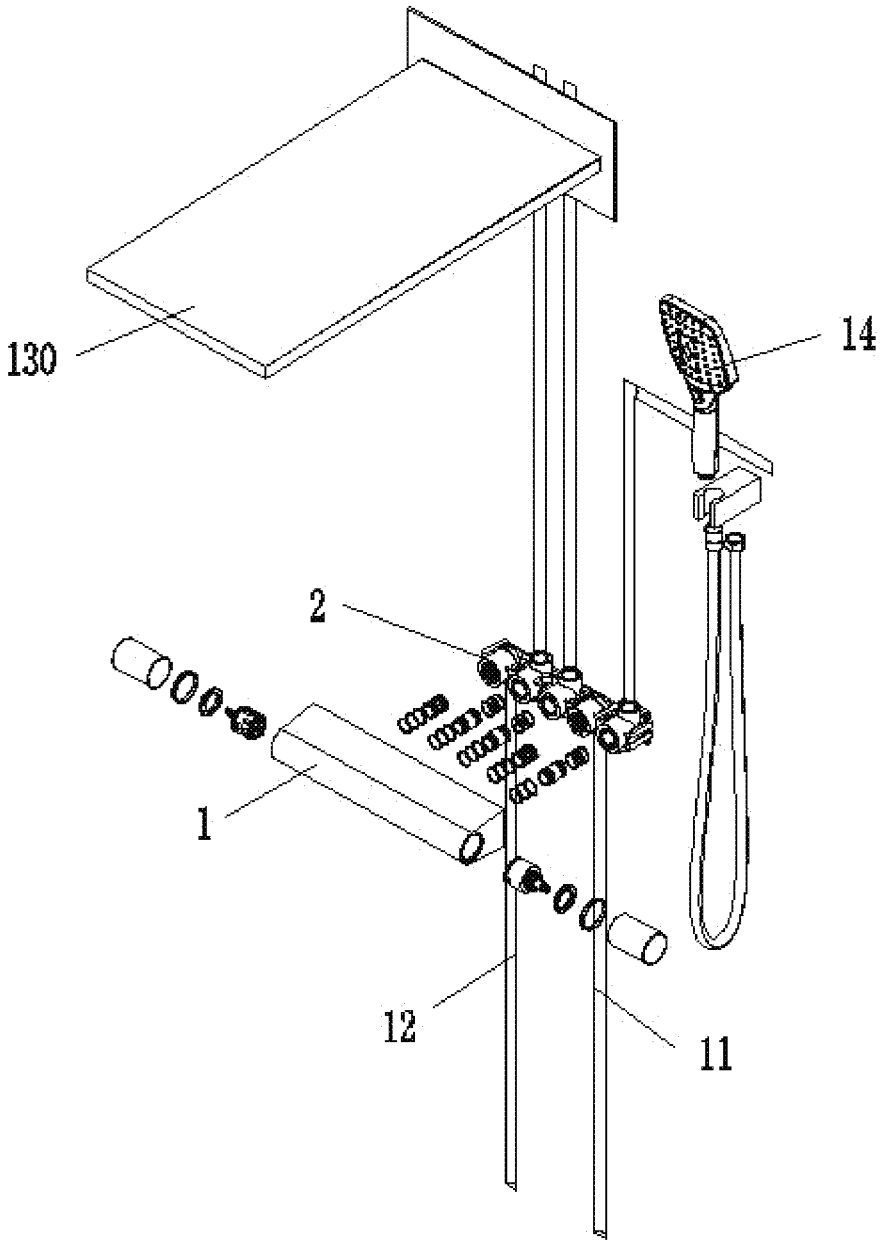
FIG. 5 is the structural diagram of embodiment 2.
Figure 6:
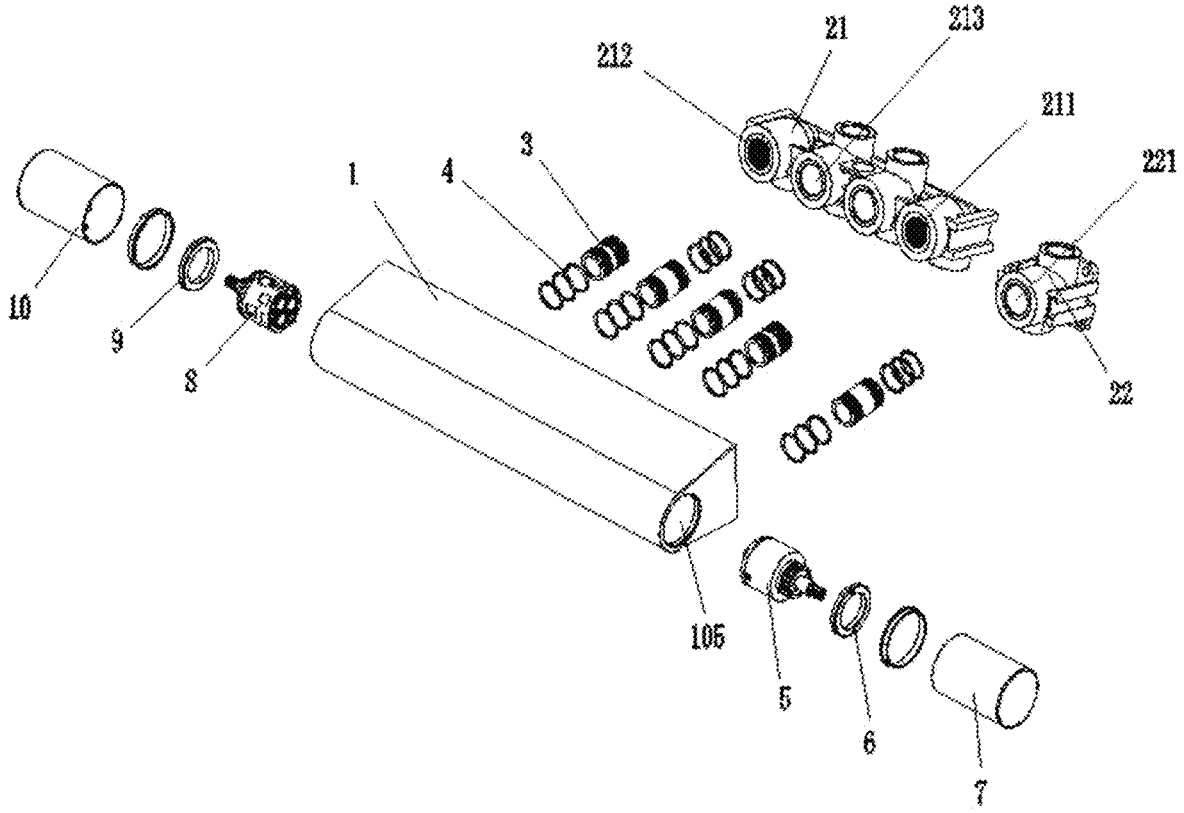
FIG. 6 is the assembly structure diagram of the shower body and concealed body of embodiment 2.
Figure 7:
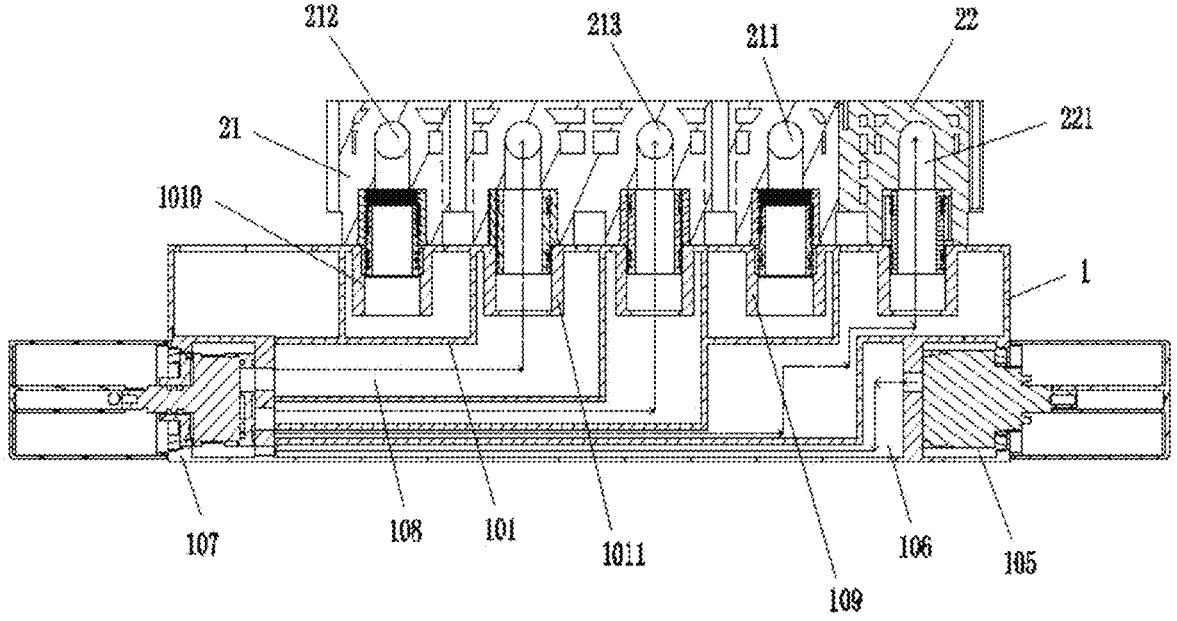
FIG. 7 is the sectional diagram of the upper structure of the shower body in embodiment 2.
Figure 8:
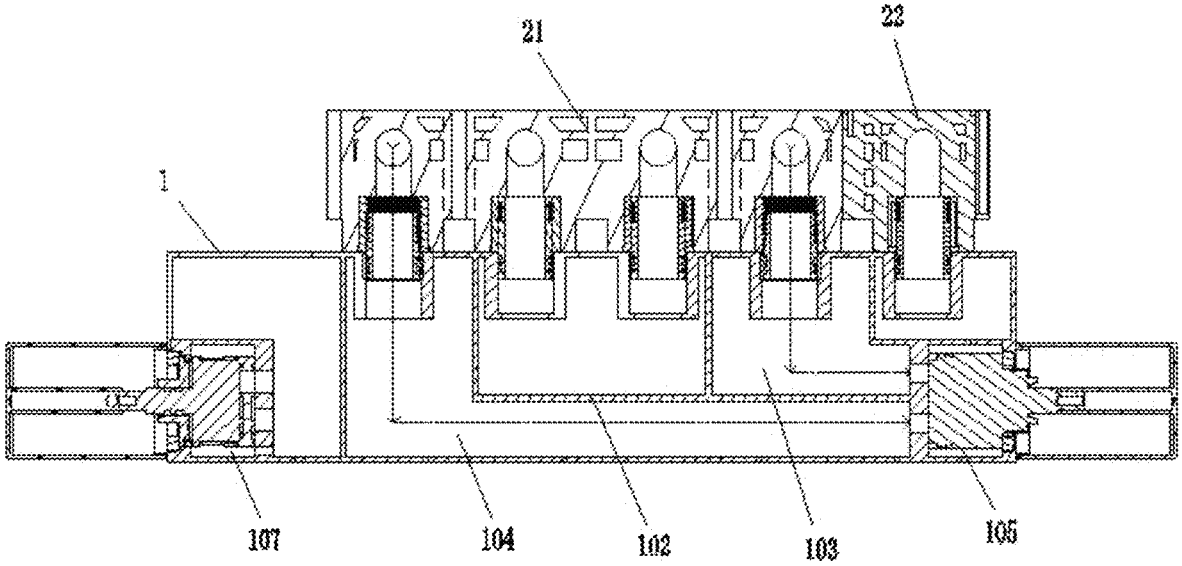
FIG. 8 is the sectional diagram of the lower structure of the shower body in embodiment 2.

The technical scheme of the invention is further described clearly and detailedly hereinafter with reference to the drawings. Obviously, only partial embodiments of the invention are shown and the actual structure is not limited thereto. All other embodiments, which can be obtained by those skilled in the art without making any creative effort based on the embodiments in the present invention, and any modifications, equivalent substitutions, improvements, etc., made shall all fall within the protective scope of the invention.

Embodiment 1 As shown from FIG. 1 to FIG. 4, the embodiment discloses a multifunctional shower device, comprising a shower body 1 and a concealed body 2, wherein the rear end of the shower body 1 is connected to the concealed body 2; the top end of said concealed body 2 is connected to two water outlet devices, and the bottom end thereof is connected to the cold water inlet pipe 11 and hot water inlet pipe 12, and water flow in the cold water inlet pipe 11 and hot water inlet pipe 12 flows into the shower body 1 for temperature regulation; the temperature-regulated water flow controlled by the shower body 1 is flowed out from two outlet devices; said water outlet devices are overhead shower 13 and handheld shower 14.

The rear end of said shower body 1 is sequentially provided with a cold water inlet 109, two functional water outlets 1011 and a hot water inlet 1010, a switch cavity 105 is provided on one side of the front end of the shower body 1 and a switch component is mounted in the switch cavity 105; two control cavities 107 are provided at the front end of the shower body 1, two control cavities 107 are set according to two corresponding functional water outlets 1011 and control components are mounted in the control cavities 107; in the shower body 1 is provided with an upper cavity and a lower cavity from the top to the bottom; the upper cavity, lower cavity, switch cavity 105 and two control cavities are all relatively independent; in the upper cavity is provided with the first separator plate 101 and the upper cavity is divided into the first connecting cavity 106 and two second connecting cavities 108 via the first separator plate 101; the switch cavity 105 is connected to two control cavities 107 through the first connecting cavity 106, two second connecting cavities 108 are set according to two corresponding control cavities 107 and the control cavities 107 are connected to the corresponding functional water outlets 1011 through the second connecting cavities 108; in the lower cavity is provided with the second separator plate 102 and the lower cavity is divided into relatively independent cold water cavity 103 and hot water cavity 104 via the second separator plate 102 wherein the cold water cavity 103 is connected to the cold water inlet 109 and switch cavity 105 respectively, and the hot water cavity 104 is connected to the hot water inlet 1010 and switch cavity 105 respectively.

Said switch component includes a switch valve core 5, the first gland 6, and a switch handle 7 wherein the switch valve core 5 is embedded in the switch cavity 105, the first gland 6 is connected to the inside wall of the switch cavity 105; the control terminal at one end of the switch valve core 5 is connected to the switch handle 7 after penetrating through the center hole of the first gland 6.

Said control component comprises a control valve core 8, the second gland 9, and a control knob 10 wherein the control valve core 8 is embedded in the control cavity 107, the second gland 9 is connected to the inside wall of the control cavity 107, and the control terminal at one end of the control valve core 8 is connected to the control knob 10 after penetrating through the center hole of the second gland 9.

Said concealed body 2 includes a fixed block 21; on the fixed block 21 is sequentially provided with a cold water inlet channel 211, two water outlet channels 213, and a hot water inlet channel 212 wherein the bottom end of cold water inlet channel 211 is connected with the cold water inlet pipe 11 and the top end of cold water inlet channel 211 is connected with the cold water inlet 109 at the rear end of the shower body 1; the bottom end of hot water inlet channel 212 is connected with the hot water inlet pipe 12 and the top end of hot water inlet channel 121 is connected with the hot water inlet 1010 at the rear end of the shower body 1; two water outlet channels 213 are provided in correspondence with two functional water outlets 1011 at the rear end of the shower body 1, the bottom end of two water outlet channels 213 are connected to the corresponding functional water outlets 1011, and the top end of two water outlet channels 213 are connected to the pipe of overhead shower 13 and handheld shower 14, respectively.

Said cold water inlet channel 211, two water outlet channels 213, and hot water inlet channel 212 are provided with mounting connectors 3 at one end connected to the shower body 1 and are connected to the cold water inlet 109, two functional water outlets 1011, and the hot water inlet 1010 at the rear end of the shower body 1 via the mounting connectors 3, and two ends of the mounting connector 3 are in threaded connection with the concealed body 2 and the shower body 1, respectively; sealing washers 4 are provided between the mounting connector 3 and the shower body 1, and between the mounting connector 3 and the concealed body 2; the sealing washer 4 is socketed on the outside of both ends of the mounting connector 3.

Said concealed body 2, cold water inlet pipe 11, hot water inlet pipe 12, and connecting pipes of overhead shower 13 and handheld shower 14 are pre-buried in the building wall.

Embodiment 2 As shown from FIG. 5 to FIG. 8, the embodiment discloses a multifunctional shower device, comprising a shower body 1 and a concealed body 2, wherein the rear end of the shower body 1 is connected to the concealed body 2; the top end of said concealed body 2 is connected to two water outlet devices, and the bottom end thereof is connected to the cold water inlet pipe 11 and hot water inlet pipe 12, and water flow in the cold water inlet pipe 11 and hot water inlet pipe 12 flows into the shower body 1 for temperature regulation; the temperature-regulated water flow controlled by the shower body 1 is flowed out from two outlet devices; said water outlet devices are handheld shower 14 and dual-function overhead spray member 130.

The rear end of said shower body 1 is sequentially provided with a cold water inlet 109, three functional water outlets 1011 and a hot water inlet 1010, a switch cavity 105 is provided on one side of the front end of the shower body 1 and a switch component is mounted in the switch cavity 105; a control cavity 107 is provided at the front end of the shower body 1, the control cavity 107 is set according to three corresponding functional water outlets 1011 and control component is mounted in the control cavity 107 and water outlet states of three functional water outlets 1011 are switched by the control component; in the shower body 1 is provided with an upper cavity and a lower cavity from the top to the bottom; the upper cavity, lower cavity, switch cavity 105 and control cavity are all relatively independent; in the upper cavity is provided with the first separator plate 101 and the upper cavity is divided into the first connecting cavity 106 and three second connecting cavities 108 via the first separator plate 101; the switch cavity 105 is connected to the control cavity 107 through the first connecting cavity 106, three second connecting cavities 108 are connected with the control cavity 107 and the control cavity 107 is connected to the corresponding functional water outlets 1011 through the second connecting cavities 108; in the lower cavity is provided with the second separator plate 102 and the lower cavity is divided into relatively independent cold water cavity 103 and hot water cavity 104 via the second separator plate 102 wherein the cold water cavity 103 is connected to the cold water inlet 109 and switch cavity 105 respectively, and the hot water cavity 104 is connected to the hot water inlet 1010 and switch cavity 105 respectively.

Said switch component includes a switch valve core 5, the first gland 6, and a switch handle 7 wherein the switch valve core 5 is embedded in the switch cavity 105, the first gland 6 is connected to the inside wall of the switch cavity 105; the control terminal at one end of the switch valve core 5 is connected to the switch handle 7 after penetrating through the center hole of the first gland 6.

Said control component is the water distribution switch, which comprises a control valve core 8, the second gland 9, and a control knob 10 wherein the control valve core 8 is embedded in the control cavity 107, the second gland 9 is connected to the inside wall of the control cavity 107, and the control terminal at one end of the control valve core 8 is connected to the control knob 10 after penetrating through the center hole of the second gland 9.

Said concealed body 2 includes a fixed block 21 and a movable block 22, and the movable block 22 is connected to one side of the fixed block 21 via mortise and tenon joint structure; said fixed block 21 is equipped with a cold water inlet channel 211, two first water outlet channels 213, and a hot water inlet channel 212; one end of the cold water inlet channel 211 is connected with the cold water inlet pipe 11, one end of the hot water inlet channel 212 is connected to the hot water inlet pipe 12, and the other end of the cold water inlet channel 211 and hot water inlet channel 212 are both connected to the shower body 1 set in the front end of concealed body 2; the movable block 22 is provided with a second water outlet channel 221; one end of the first outlet channels 213 and the second water outlet channel 221 are both connected to the shower body 1, while the other end of the first water outlet channel 213 is connected to the dual-function overhead spray member 130, and the other end of the second water outlet channel 221 is connected to the pipe of handheld shower 14.

Figure 9:
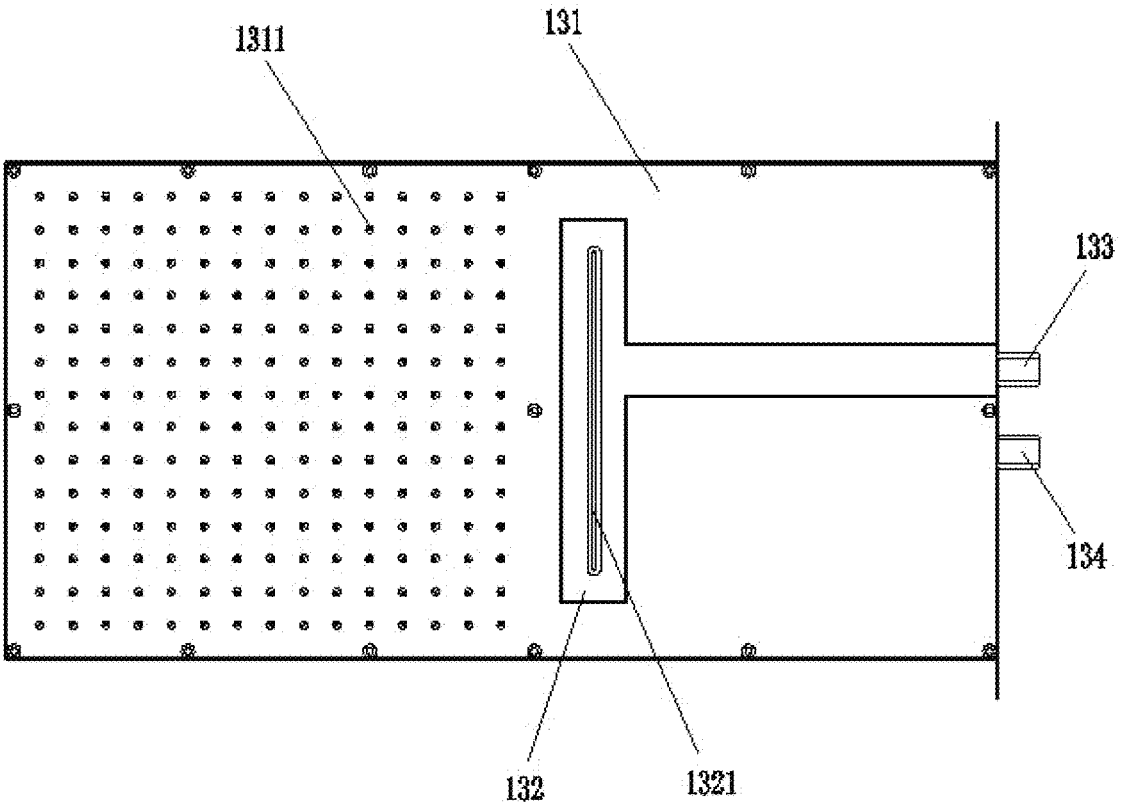
FIG. 9 is the bottom view of the dual-function overhead spray member.
Figure 10:
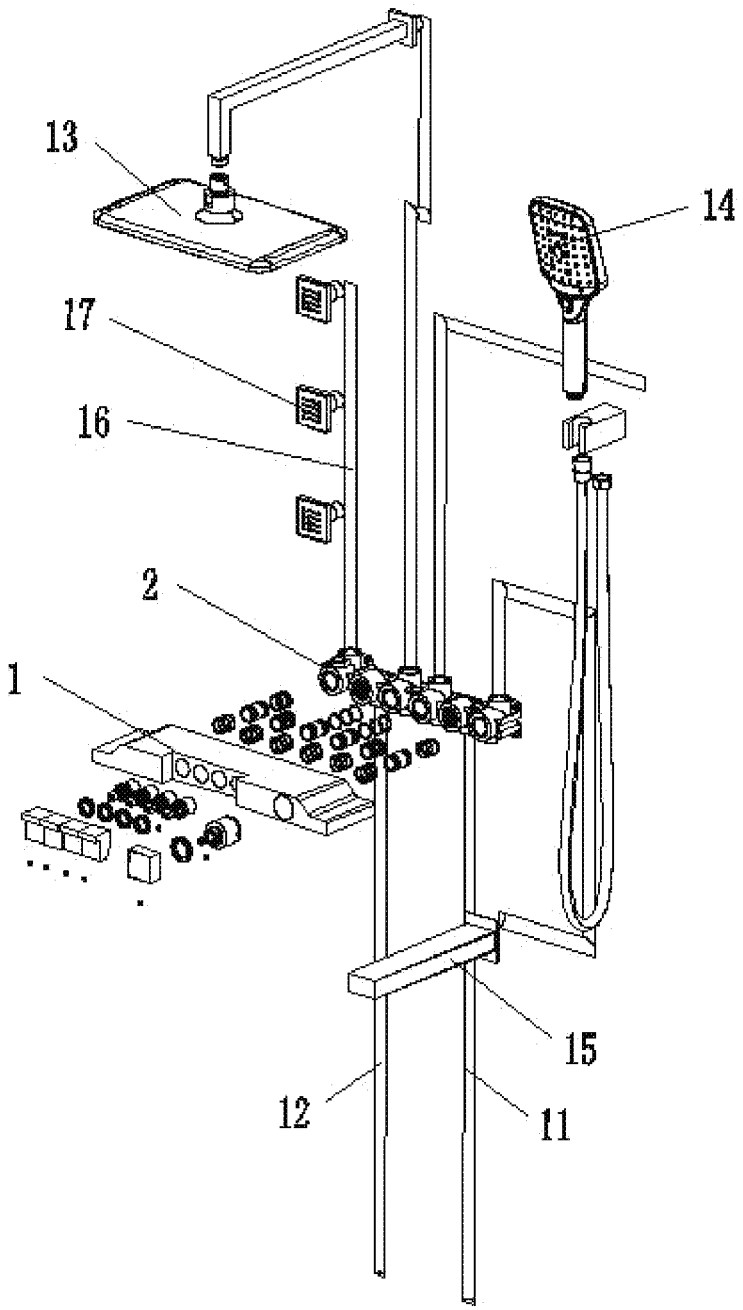
FIG. 10 is the structural diagram of embodiment 3.
Figure 11:
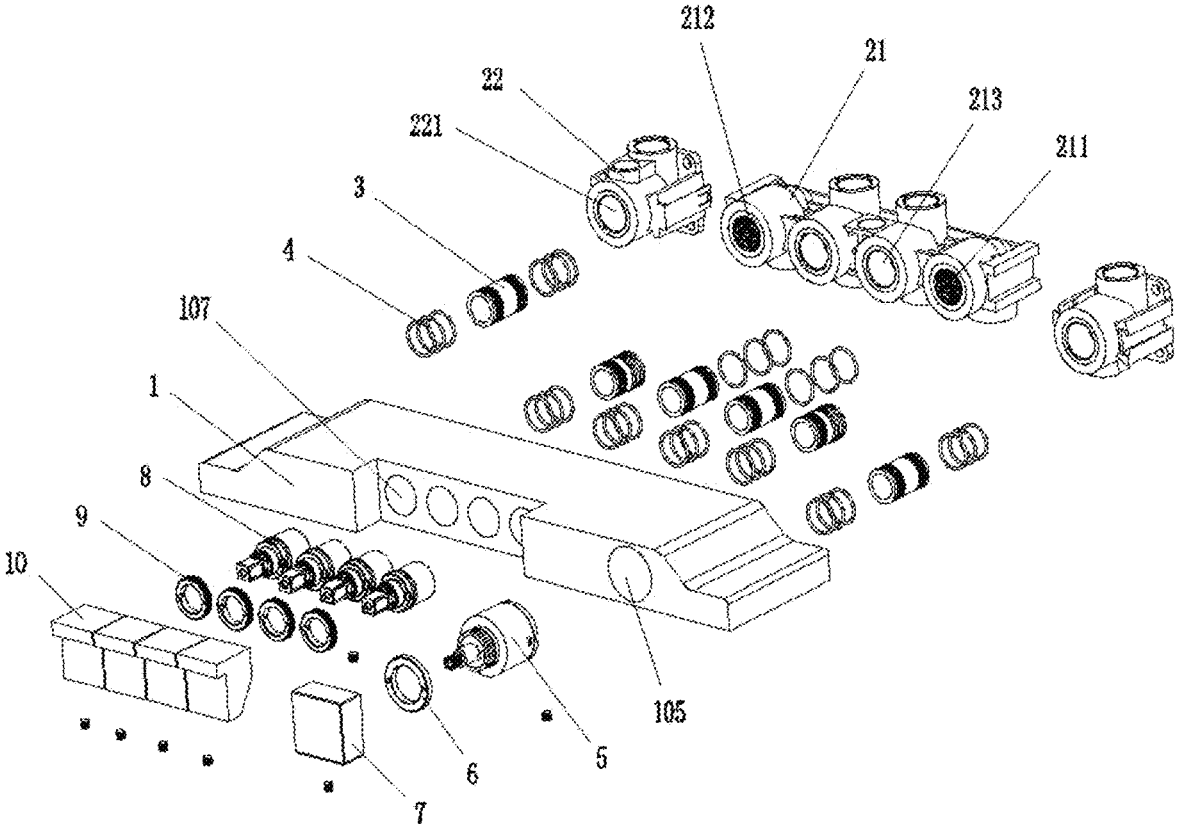
FIG. 11 is the assembly structure diagram of the shower body and concealed body of embodiment 3.
Figure 12:
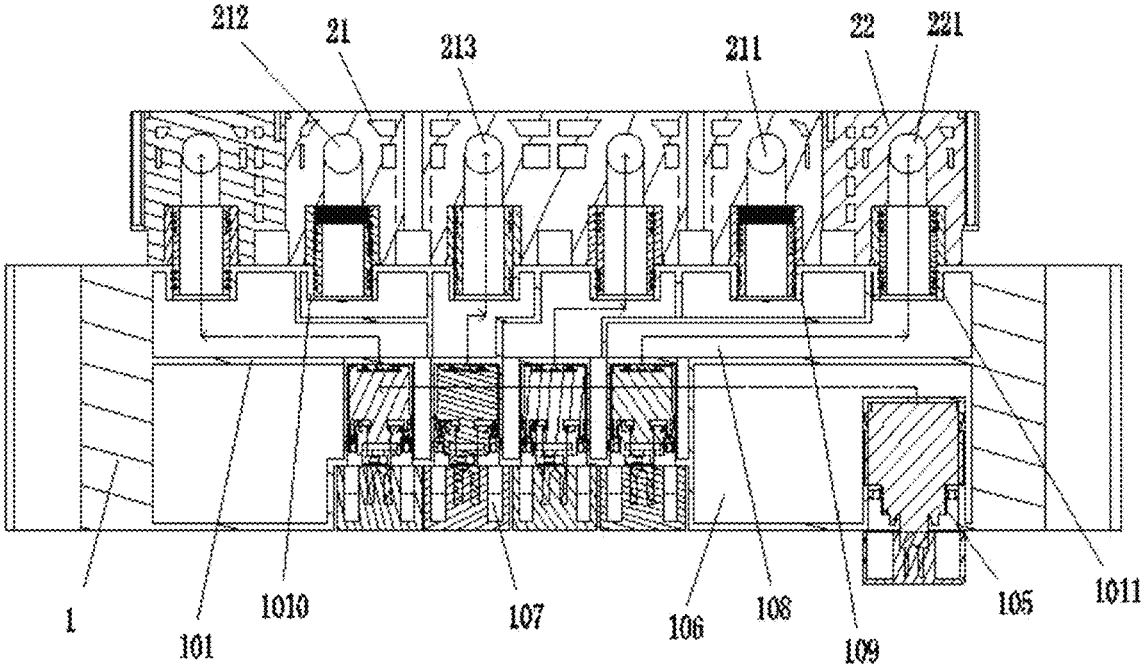
FIG. 12 is the sectional diagram of the upper structure of the shower body in embodiment 3.
Figure 13:
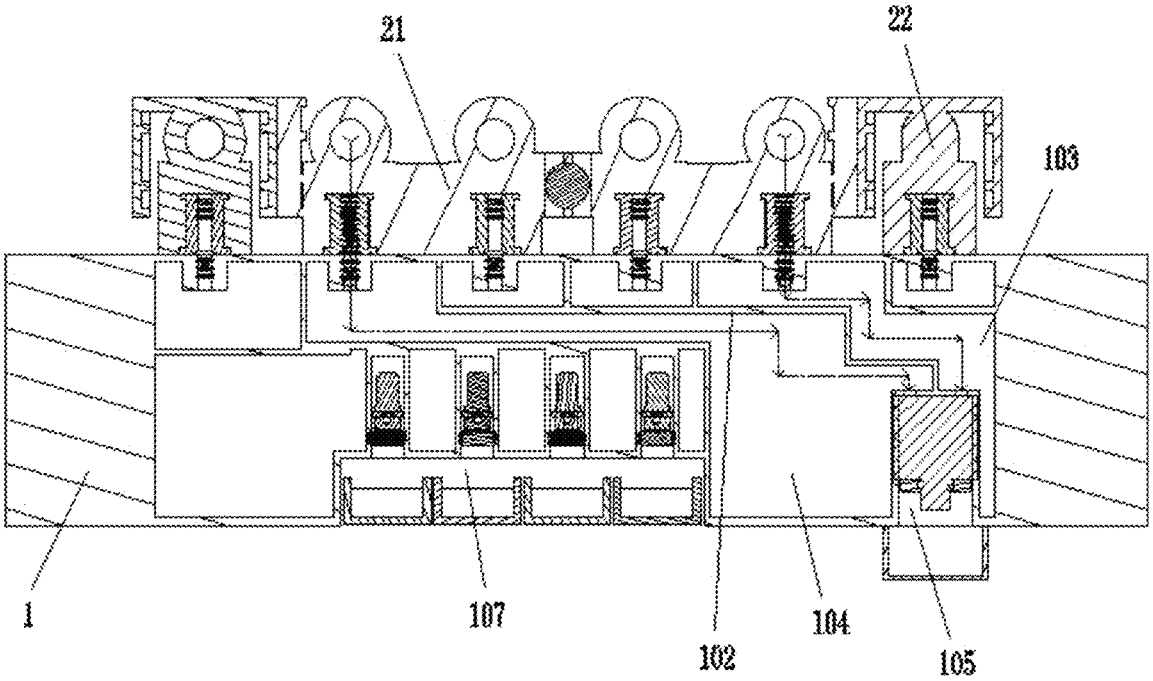
FIG. 13 is the sectional diagram of the lower structure of the shower body in embodiment 3.

As shown in FIG. 9, said dual-function overhead spray member 130 includes a top shell 131, which is a hollow shell structure, top spray holes 1311 are provided at the bottom front end of the top shell 131, a waterfall outlet shell 132 is provided at the back end of the top shell 131, a waterfall outlet 1321 is provided at the bottom end of the waterfall outlet shell 132 and the waterfall outlet 1321 extends from the bottom back end of the top shell 131; the back end of the top shell 131 is provided with the first water flow connector 134 to be connected to the inside of the top shell 131 and the second water flow connector 133 to be connected to the inside of the waterfall outlet shell 132; the first water flow connector 134 and the second water flow connector 133 are connected to the pipes of two first water outlet channels 213, respectively. The dual-function overhead spray member has top shower and top waterfall two outlet modes, the top shower mode is the shower-like outlet mode, with large spray area; the top waterfall is the direct outlet mode, with larger water volume and small spray area; switch of outlet mode can be realized through controlling different first water outlet channels.

Said cold water inlet channel 211, two water outlet channels 213, and hot water inlet channel 212 are provided with mounting connectors 3 at one end connected to the shower body 1 and are connected to the cold water inlet 109, three functional water outlets 1011, and the hot water inlet 1010 at the rear end of the shower body 1 via the mounting connectors 3, and two ends of the mounting connector 3 are in threaded connection with the concealed body 2 and the shower body 1, respectively; sealing washers 4 are provided between the mounting connector 3 and the shower body 1, and between the mounting connector 3 and the concealed body 2; the sealing washer 4 is socketed on the outside of both ends of the mounting connector 3.

Said concealed body 2, cold water inlet pipe 11, hot water inlet pipe 12, and connecting pipes of handheld shower 14 and dual-function overhead spray member 130 are pre-buried in the building wall.

Embodiment 3 As shown from FIG. 10 to FIG. 13, the embodiment discloses a multifunctional shower device, comprising a shower body 1 and a concealed body 2, wherein the rear end of the shower body 1 is connected to the concealed body 2; the top end of said concealed body 2 is connected to four water outlet devices, and the bottom end thereof is connected to the cold water inlet pipe 11 and hot water inlet pipe 12, and water flow in the cold water inlet pipe 11 and hot water inlet pipe 12 flows into the shower body 1 for temperature regulation; the temperature-regulated water flow controlled by the shower body 1 is flowed out from four outlet devices; said water outlet devices are overhead shower 13, handheld shower 14, faucet 15, and side spray shower.

The rear end of said shower body 1 is sequentially provided with a cold water inlet 109, four functional water outlets 1011 and a hot water inlet 1010, a switch cavity 105 is provided on one side of the front end of the shower body 1 and a switch component is mounted in the switch cavity 105; four control cavities 107 are provided at the front end of the shower body 1, four control cavities 107 are set according to four corresponding functional water outlets 1011 and control components are mounted in the control cavities 107; in the shower body 1 is provided with an upper cavity and a lower cavity from the top to the bottom; the upper cavity, lower cavity, switch cavity 105 and control cavities are all relatively independent; in the upper cavity is provided with the first separator plate 101 and the upper cavity is divided into the first connecting cavity 106 and four second connecting cavities 108 via the first separator plate 101; the switch cavity 105 is connected to four control cavities 107 through the first connecting cavity 106, four second connecting cavities 108 are set according to four corresponding control cavities 107 and the control cavities 107 are connected to the corresponding functional water outlets 1011 through the second connecting cavities 108; in the lower cavity is provided with the second separator plate 102 and the lower cavity is divided into relatively independent cold water cavity 103 and hot water cavity 104 via the second separator plate 102 wherein the cold water cavity 103 is connected to the cold water inlet 109 and switch cavity 105 respectively, and the hot water cavity 104 is connected to the hot water inlet 1010 and switch cavity 105 respectively.

Said switch component includes a switch valve core 5, the first gland 6, and a switch handle 7 wherein the switch valve core 5 is embedded in the switch cavity 105, the first gland 6 is connected to the inside wall of the switch cavity 105; the control terminal at one end of the switch valve core 5 is connected to the switch handle 7 after penetrating through the center hole of the first gland 6.

Said control component comprises a control valve core 8, the second gland 9, and a control knob 10 wherein the control valve core 8 is embedded in the control cavity 107, the second gland 9 is connected to the inside wall of the control cavity 107, and the control terminal at one end of the control valve core 8 is connected to the control knob 10 after penetrating through the center hole of the second gland 9.

Said concealed body 2 includes a fixed block 21 and two movable blocks 22, and two movable blocks 22 are connected to two sides of the fixed block 21 via mortise and tenon joint structure; said fixed block 21 is equipped with a cold water inlet channel 211, two first water outlet channels 213, and a hot water inlet channel 212; one end of the cold water inlet channel 211 is connected with the cold water inlet pipe 11, one end of the hot water inlet channel 212 is connected to the hot water inlet pipe 12, and the other end of the cold water inlet channel 211 and hot water inlet channel 212 are both connected to the shower body 1 set in the front end of concealed body 2; on each movable block 22 is provided with a second water outlet channel 221; one end of the first outlet channels 213 and the second water outlet channel 221 are both connected to the shower body 1, while the other end of two first water outlet channels 213 are connected to the dual-function overhead spray member 130, and the other end of two second water outlet channels 221 are connected to the pipes of overhead shower 13, handheld shower 14, faucet 15, and side spray shower.

Said side spray shower includes a mounting pipe 16, which is longitudinally arranged, and the bottom end of the mounting pipe 16 is connected to one of second water outlet channels 221; three mounting interfaces are set at equal spacing on the side wall of the mounting pipe 16 along the lengthwise direction of the mounting pipe and are connected to three longitudinal shower heads 17 through the mounting interfaces; when water is outlet, the water flows into the mounting pipe and spray from three shower heads at the same time, allowing for showering operations for locations such as people's backs.

Said cold water inlet channel 211, two first water outlet channels 213, two second water outlet channels 221, and hot water inlet channel 212 are provided with mounting connectors 3 at one end connected to the shower body 1 and are connected to the cold water inlet 109, four functional water outlets 1011, and the hot water inlet 1010 at the rear end of the shower body 1 via the mounting connectors 3, and two ends of the mounting connector 3 are in threaded connection with the concealed body 2 and the shower body 1, respectively; sealing washers 4 are provided between the mounting connector 3 and the shower body 1, and between the mounting connector 3 and the concealed body 2; the sealing washer 4 is socketed on the outside of both ends of the mounting connector 3.

Said concealed body 2, cold water inlet pipe 11, hot water inlet pipe 12, and connecting pipes of overhead shower 13, handheld shower 14, faucet 15 are all pre-buried in the building wall.

The invention adopts the design of setting the upper cavity and lower cavity from top to bottom in the shower body, so that when in use, it enables the lower cavity, divided into cold water cavity and hot water cavity, supplies water for the switch cavity; the switch component in the switch cavity regulates the temperature of the incoming water flow, then the water flow enters into the control cavity through the first connecting cavity, and then the water flow state is controlled through the control component, after which the water flows out through the corresponding second connecting cavities and the corresponding functional water outlets, finally realizing water discharge of different water outlet devices; its structure is simple and convenient for operation, enhancing the using effect of shower device;

Through utilizing that the fixed block and movable blocks can be detachably connected to form the design of concealed body, in the use of the invention, the cold water inlet pipe and hot water inlet pipe can be respectively connected to the cold water inlet channel and the hot water inlet channel on the fixed block, and then the first water outlet channel on the fixed block and the second water outlet channel on the movable block can be connected to the water outlet device; the number of movable blocks can be increased to meet people's use demand for the water outlet device so as to obtain a concealed body structure that meets people's demand; its assembly operation is convenient and quick, which reduces the production cost of the shower device and further improves the using effect of the shower device;

On the other hand, when installing the invention, the concealed body and all kinds of pipes are pre-buried in the wall, and only the shower body is exposed outside the wall, which not only facilitates the operation and control of the shower equipment but also facilitates the disassembling and maintenance of the shower device in future. At the same time, it avoids the exposure of various pipes in the bathroom, effectively improving the aesthetic effect in the bathroom, thus improving the use effects of the invention.

The invention claimed is:

1. A multifunctional shower device, comprising a shower body and a concealed body, wherein a rear end of the shower body is connected to the concealed body; a top end of the concealed body is connected to water outlet devices, and a bottom end of the concealed body is connected to cold water inlet pipe and hot water inlet pipe, and water flow in the cold water inlet pipe and the hot water inlet pipe flows into the shower body for temperature regulation; the temperature-regulated water flow controlled by the shower body is flowed out from one or more the water outlet devices; the water outlet devices comprising one or more combinations of overhead shower, handheld shower, faucet, overhead spray member, and side spray shower;

the rear end of the shower body is sequentially provided with a cold water inlet, functional water outlets and a hot water inlet, a switch cavity is provided on one side of a front end of the shower body, a switch component is mounted in the switch cavity; control cavities are provided at the front end of the shower body, the control cavities are set corresponding to the functional water outlets, control components are mounted in the control cavities; the shower body is provided with an upper cavity and a lower cavity from top to bottom; the upper cavity, the lower cavity, the switch cavity and the control cavities are all relatively independent; the upper cavity is provided with a first separator plate, the upper cavity is divided into a first connecting cavity and second connecting cavities via the first separator plate; the switch cavity is connected to control cavities through the first connecting cavity, the second connecting cavities are set corresponding to the control cavities, the control cavities are connected to the corresponding functional water outlets through the second connecting cavities; the lower cavity is provided with the second separator plate, the lower cavity is divided into relatively independent cold water cavity and hot water cavity via the second separator plate, the cold water cavity is connected to the cold water inlet and switch cavity respectively, and the hot water cavity is connected to the hot water inlet and switch cavity respectively;

the switch component comprising a switch valve core, a first gland, and a switch handle, the switch valve core is embedded in the switch cavity, the first gland is connected to inside wall of the switch cavity; a control terminal on one end of the switch valve core passes through a center hole of the first gland and connects to the switch handle.

2. The multifunctional shower device of claim 1 wherein in the concealed body is sequentially provided with a cold water inlet channel, water outlet channels, and a hot water inlet channel, a bottom end of cold water inlet channel is connected with the cold water inlet pipe, a top end of the cold water inlet channel is connected with the cold water inlet at the rear end of the shower body; bottom end of the hot water inlet channel is connected with the hot water inlet pipe and the top end of the hot water inlet channel is connected with the hot water inlet at the rear end of the shower body; the water outlet channels are provided in correspondence with the functional water outlets at the rear end of the shower body, the bottom end of the water outlet channels are connected to the corresponding functional water outlets, and a top end of the water outlet channels are connected to the water outlet device.

3. The multifunctional shower device of claim 2 wherein the concealed body comprising a fixed block and movable blocks, the movable blocks are set side by side on one side or both sides of the fixed block, and the fixed block and the movable blocks or adjacent movable blocks are detachably connected with each other via mortise and tenon joint or buckle structure; the fixed block is equipped with the cold water inlet channel, first water outlet channels, and the hot water inlet channel; one end of the cold water inlet channel is connected with the cold water inlet pipe, one end of the hot water inlet channel is connected to the hot water inlet pipe, and other end of the cold water inlet channel and the hot water inlet channel are both connected to the shower body set in the front end of the concealed body; each the movable block is provided with a second water outlet channel; one end of the first outlet channels and the second water outlet channel are both connected to the shower body, other end of the first water outlet channel and the second water outlet channel are both connected to the water outlet devices.

4. The multifunctional shower device of claim 2 wherein the cold water inlet channel, the water outlet channels, and the hot water inlet channel are provided with mounting connectors at one end connected to the shower body, the mounting connectors connect to the cold water inlet, the functional water outlets, and the hot water inlet at the rear end of the shower body, and two ends of the mounting connector are in threaded connection with the concealed body and the shower body, respectively; sealing washers are provided between the mounting connector and the shower body; the sealing washer is socketed on the outside of both ends of the mounting connector.

5. The multifunctional shower device of claim 1 wherein the control component comprising a control valve core, a second gland, and a control knob, the control valve core is embedded in control cavity, the second gland is connected to a inside wall of the control cavity, the control terminal on one end of the control valve core passes through a center hole of the second gland and connects to the control button.

6. The multifunctional shower device of claim 2 wherein the overhead spray member comprising a top shell, the top shell is a hollow shell structure, top spray holes are provided at a bottom front end of the top shell, a waterfall outlet shell is provided at a back end of the top shell, a waterfall outlet is provided at a bottom end of the waterfall outlet shell, the waterfall outlet extends from a bottom back end of the top shell; the back end of the top shell is provided with a first water flow connector and a second water flow connector, the first water flow connector communicates with a interior of the top shell, and the second water flow connector communicates with a interior of the waterfall outlet shell, the first water flow connector and the second water flow connector are connected to the pipes of two water outlet channels respectively.

7. The multifunctional shower device of claim 2 wherein the side spray shower comprising a mounting pipe, the mounting pipe is longitudinally arranged, and a bottom end of the mounting pipe is connected to the water outlet channel; mounting interfaces are set at equal spacing on side wall of the mounting pipe along the lengthwise direction of the mounting pipe, a shower head is connected through the mounting interfaces.

8. The multifunctional shower device of claim 1 wherein the concealed body, the cold water inlet pipe, the hot water inlet pipe, and connecting pipes of each the water outlet device are pre-buried in building wall.

* * * * *